US008898839B2

(12) United States Patent
Kenalty et al.

(10) Patent No.: US 8,898,839 B2
(45) **Date of Patent: *Dec. 2, 2014**

(54) EVACUATION SLED

(75) Inventors: Christopher Kenalty, Toronto (CA); Miriam Gordon, Mississauga (CA)

(73) Assignee: Evacusled Inc., Toronto (CA)

( * ) Notice: Subject to any disclaimer, the term of this patent is extended or adjusted under 35 U.S.C. 154(b) by 251 days.

This patent is subject to a terminal disclaimer.

(21) Appl. No.: 13/452,079

(22) Filed: Apr. 20, 2012

(65) Prior Publication Data

US 2013/0276227 A1 Oct. 24, 2013

(51) Int. Cl.
*A61G 1/00* (2006.01)

(52) U.S. Cl.
USPC ..... 5/628; 5/625; 5/627; 224/158; 280/18

(58) Field of Classification Search
CPC ..... A61G 1/00; A61G 1/01; A61G 1/013; A61G 1/044
USPC ..... 5/81.1 R, 86.1, 625, 628, 627; 128/870; 224/158; 280/18, 19
See application file for complete search history.

(56) References Cited

U.S. PATENT DOCUMENTS 2,279,694 A * 4/1942 Martinson ..... 5/627
2,788,530 A * 4/1957 Ferguson ..... 5/628
3,222,080 A * 12/1965 Kinraide ..... 280/18
4,283,068 A * 8/1981 Keyser ..... 280/19
4,627,428 A 12/1986 Brooks
4,736,474 A 4/1988 Moran et al.
4,793,008 A 12/1988 Johansson
5,014,374 A * 5/1991 Williams ..... 5/628
5,016,299 A 5/1991 Boulanger
5,050,254 A 9/1991 Murphy
5,150,487 A 9/1992 Hemphill
5,189,746 A 3/1993 Horie
5,249,321 A 10/1993 Graf
5,285,797 A * 2/1994 Zeller ..... 5/628

(Continued)

FOREIGN PATENT DOCUMENTS

EP 0 165 043 A2 12/1985
GB 2182570 A 5/1987
WO 8607253 A1 12/1986
WO 2009/147536 A3 1/2010

OTHER PUBLICATIONS

U.S. Appl. No. 12/968,840, filed Dec. 15, 2010, entitled "Subway Evacuation Mattress and Method of Manufacture" to Kenalty et al.

*Primary Examiner* — Nicholas Polito
(74) *Attorney, Agent, or Firm* — Katten Muchin Rosenman LLP

(57) ABSTRACT

An evacuation sled for non-ambulatory patients preferably including a sheet having a plurality of handholds disposed about the left and right side edges of the sheet, each handhold comprising an opening with a reinforcement above the opening. A plurality of patient retention straps are coupled to the sheet and are configured to secure a patient in the sheet when the sheet is curved upward about the patient. A pull strap is coupled through a head of the sheet and is configured to permit a person to drag the patient strapped to the sheet. Preferably, a foot strap is affixed to the head pull strap and coupled to the foot of the sheet. The foot strap is configured to cause, when tension is applied to the head pull strap, at least one portion of the plastic sheet foot to raise upward and at least partially enclose the feet of the patient.

20 Claims, 8 Drawing Sheets

(56) References Cited

U.S. PATENT DOCUMENTS

| | | | | |
|---|---|---|---|---|
| D421,413 | S * | 3/2000 | Calkin | D12/128 |
| 6,871,368 | B2 * | 3/2005 | Calkin | 5/628 |
| 7,055,190 | B2 | 6/2006 | Barth et al. | |
| 7,216,378 | B2 | 5/2007 | Barth et al. | |
| 7,422,220 | B2 * | 9/2008 | Walkingshaw et al. | 280/18 |
| 7,559,103 | B2 | 7/2009 | Barth et al. | |
| 7,610,640 | B2 | 11/2009 | Post | |
| 7,774,877 | B2 | 8/2010 | Kenalty et al. | |
| 7,810,820 | B2 * | 10/2010 | Wolf et al. | 280/19 |
| 8,006,334 | B2 | 8/2011 | Kenalty et al. | |
| 8,365,326 | B2 * | 2/2013 | Kenalty et al. | 5/628 |
| 2005/0246833 | A1 | 11/2005 | Barth et al. | |
| 2006/0061050 | A1 | 3/2006 | Wolf et al. | |
| 2006/0200905 | A1 | 9/2006 | Barth | |
| 2007/0278754 | A1 | 12/2007 | Walkingshaw | |
| 2008/0301876 | A1 | 12/2008 | Kenalty et al. | |
| 2009/0288255 | A1 * | 11/2009 | Sakurai et al. | 5/625 |
| 2010/0005593 | A1 * | 1/2010 | Bowling et al. | 5/627 |
| 2010/0251479 | A1 | 10/2010 | Kenalty et al. | |
| 2010/0253022 | A1 | 10/2010 | Wolf et al. | |
| 2011/0185504 | A1 | 8/2011 | Kenalty et al. | |
| 2011/0271445 | A1 | 11/2011 | Kenalty et al. | |
| 2013/0139319 | A1 * | 6/2013 | Kenalty et al. | 5/628 |

* cited by examiner

100

EVACUATION SLED

TECHNICAL FIELD

The present invention relates generally to rescue and/or evacuation sleds for non-ambulatory or bed-ridden persons. More particularly, the invention relates to such a device in which a patient may be rapidly and securely enclosed before transfer from a hospital bed to a safe location over land.

BACKGROUND INFORMATION

Evacuation sleds are used by hospitals, assisted living facilities, emergency services, etc., to rapidly and safely evacuate patients from danger zones, such as flood areas. The patient is typically transferred from a bed into the sled, lowered to the floor, and then evacuated by pulling or dragging. An efficient evacuation sled can be deployed and used by a single nurse or other first responder. An evacuation mattress is disclosed in International Application Number PCT/NL 86/00015, published Dec. 18, 1986 under No. WO 86/07253, based on a Netherlands application filed Jun. 12, 1985. The mattress is characterized by belts or ropes to be put around the patient, which are permanently fastened to the mattress. Such a mattress, while very useful, may be relatively expensive to buy, store, and maintain.

While many sleigh-type patient evacuation sleds are known (such as the evacuation sled disclosed in U.S. Patent Publication No. 2007/0278754 to Walkingshaw), these sleds require several caregivers to transfer the patient into the sled for evacuation. The sled is then dragged through the hospital, down numerous flights of stairs, and then to an evacuation center where the patient waits (often for hours) for transportation to a hospital, where the patient must be removed from the sled and placed in a bed (again requiring several caregivers). This leads to problems such as patient contusions from being bounced down steps, patient hypothermia, and the necessity for many caregivers to perform the multiple patient-transfer steps.

Other known structures for evacuating non-ambulatory persons include boards or mats to support the patient. For example, U.S. Pat. No. 4,793,008 to Johansson discloses rigid mats with straps, respectively placed beneath the patient's chest and thighs. A relatively complicated Rescue Transportation Mattress is disclosed in U.S. Pat. No. 4,736,474 to Moran et al., wherein an inflatable support member and crossed straps are used to secure the person being transported. Again, such solutions do little for a quick, safe, and warm evacuation of a patient from a facility during an emergency.

A child restraint device with removable semi-rigid support is disclosed in U.S. Pat. No. 4,627,428 issued Dec. 9, 1986 to Brooks. It includes a semi-rigid base and a cover attachable to the base so as to secure the child between the base and the cover. A restraining harness on top of the cover secures the entire arrangement to a transporting device.

There are numerous other patents and patent applications employing rigid or semi-rigid supports and belts or straps to secure the person transported, for example: U.S. Pat. No. 7,422,220, issued Sep. 8, 2008 to Walkingshaw; U.S. Pat. No. 6,871,368, issued Mar. 29, 2005 to Calkin; and U.S. Patent Publication No. 1006006104b0, published Mar. 23, 2006 to Wolf. One disadvantage with such sleds relates to the difficulty in securely and reliably gripping the sled for transport. Another disadvantage is that dragging the patient and sled across a rough surface, such as concrete, is difficult for all but the hardiest of nurses.

Thus, what is needed is an economical emergency sled for injured persons in areas with limited access that is capable of operation by a single caregiver, provides a warm and secure cocoon for the patient, allows easy transport over any type of surface, provides proper support for all of the patient's body, allows the patient to feel a high degree of comfort in what is otherwise a very stressful situation, and provides securing means (such as straps) to firmly hold the patient in place during transit.

SUMMARY

The present disclosure endeavors to provide an economical evacuation sled for patients that is capable of operation by a single caregiver, provides a warm and secure cocoon for the patient, allows easy transport over virtually any type of surface, provides proper support for all of the patient's body, allows the patient to feel a high degree of comfort in what is otherwise a very stressful situation, and provides securing means (such as straps) to firmly hold the patient in place during transit.

According to a first aspect, a patient evacuation sled apparatus comprises: a semi-rigid plastic sheet having (i) a head end and (ii) a foot end with a portion projecting therefrom; a plurality of body strap slits disposed along each of the left and right sides of said plastic sheet; a plurality of body straps woven through respective ones of said plurality of body strap slits, each body strap comprising a fix and release structure configured to releasably couple to secure a patient on said plastic sheet, said plurality of body straps and said plurality of body strap slits being configured to cause said plastic sheet to curve upward into a semi-cylindrical shape when said body straps are tightened; a plurality of head pull strap slits disposed substantially on a longitudinal axis of said plastic sheet; a head pull strap woven through the plurality of said head pull strap slits and configured to permit a person to pull said plastic sheet from the head end of said plastic sheet; a plurality of left side foot strap slits and a plurality of right side foot strap slits; and two ankle straps woven through said plurality of left side foot strap slits and said plurality of right side foot strap slits and coupled to a connection point.

According to a second aspect, an evacuation sled comprises: a plastic sheet having a head end and a foot end; a plurality of body straps coupled to said plastic sheet and configured to secure a patient in said plastic sheet when said plastic sheet is curved upward about the patient; a head pull strap woven through a plurality of head pull strap slits and configured to permit a person to pull said plastic sheet from the head end of said plastic sheet; two ankle straps affixed to the head pull strap and coupled at the foot end of said plastic sheet; and a pull strap coupled to at least one of the two ankle straps and configured to permit a person to drag the patient strapped to the plastic sheet.

According to a third aspect, an evacuation sled comprises; a semi-rigid plastic sheet having (i) a head end and (ii) a foot end with a portion projecting therefrom; a plurality of handholds disposed along each of left and right sides of said plastic sheet, each handhold having a reinforcing plastic member disposed on an outer edge of said each handhold a plurality of body straps coupled to said plastic sheet and configured to secure a patient in said plastic sheet when said plastic sheet is curved upward about the patient; a head pull strap woven through a plurality of head pull strap slits and configured to permit a person to pull said plastic sheet and the patient from the head of said plastic sheet; two ankle straps configured to cause, when tension is applied to said head pull strap, at least one portion of said plastic sheet foot to raise upward and at least partially enclose the feet of the patient, wherein the ankle straps are preferably configured such that one ankle strap is positioned on each side of the patient's ankles thereby preventing lateral movement of the patient's legs during transport; a ring for coupling said ankle straps to said head pull strap; and a pull strap coupled to at least one of the two ankle straps and configured to permit a person to drag the patient strapped to the plastic sheet.

In certain aspects, said ankle straps, said plurality of left side foot strap slits, and said plurality of right side foot strap slits may be configured such that, when tension is applied to said head pull strap, at least a portion of a lower left side portion of said plastic sheet and at least a portion of a lower right side portion of said plastic sheet move upward to at least partially enclose the feet of the patient.

In certain aspects, a plurality of handholds may be disposed along each of left and right sides of said plastic sheet, at least one of said handhold having a reinforcing plastic member disposed on an outer edge of said each handhold.

In certain aspects, a foot pull strap may be coupled to said ankle straps and configured to permit a person to lift or pull said plastic sheet and the patient from the foot of said plastic sheet.

In certain aspects, at least two portions of said foot strap may be disposed at substantially 5-15 degrees with respect to the longitudinal axis.

In certain aspects, a plurality of wheel assemblies may be disposed on a bottom surface of said plastic sheet.

In certain aspects, at least one flotation device may be disposed on a bottom surface of said plastic sheet.

In certain aspects, the semi-rigid plastic sheet comprises high density polyethylene and the head pull strap and/or the ankle straps may partially encircle a core material. The body straps, the head pull strap or the ankle straps may comprise nylon or polypropylene.

DETAILED DESCRIPTION

A preferred embodiment of the present invention will be described hereinbelow with reference to the accompanying drawings. In the following description, well-known functions or constructions are not described in detail since they would obscure the invention in unnecessary detail.

Figure 1:
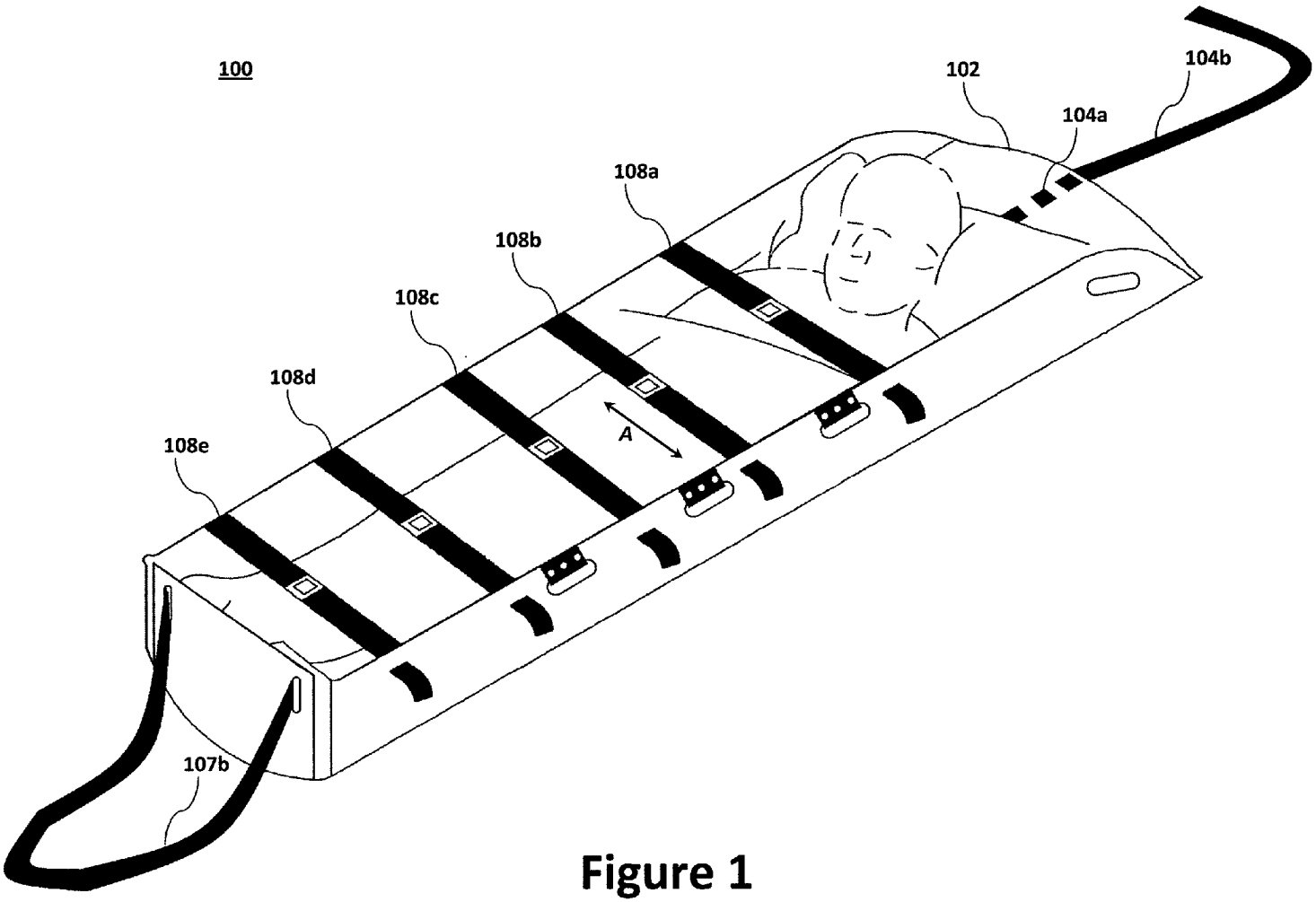
FIG. 1 is an evacuation sled in use with an patient secured in place.

FIG. 1 illustrates an evacuation sled 100 in use with a patient secured in place. The evacuation sled 100 can be rolled up perpendicular to the long axis of the evacuation sled 100 (i.e., toe to head) into a tight cylinder for transportation and/or storage when not in use. The sled 100 comprises a semi flexible base structure 102, such as a semi-rigid plastic sheet, that has a flexibility that is sufficient to allow the device to be rolled up repeatedly without substantial fatigue to the structure of the sled 100. In use, as shown in FIG. 1, once a person is lying on the sled 100, one or more body retaining straps 108*a*-108*e* may be use to secure the patient in place using buckle connectors 112*a*-112*e* and 114*a*-114*e* that can be brought together and attached over the top of the evacuee. Length 'A' of the body retaining straps 108 can then be adjusted to ensure that the person is secured on top of sled 100. The head pull strap 104*b* and foot pull strap 107*b* can then be used to pull and guide the evacuation sled 100 over land in order to evacuate the person to a safe location.

The straps 108 may be constructed from a strong fabric woven as a flat strip or tube. This type of material is more commonly known as webbing. The webbing may be woven from, for example, nylon, polypropylene, polyester, high-modulus polyethylene (e.g., Dyneema®), para-aramid synthetic fiber (e.g., Kevlar®), cotton, flax, and combinations thereof. While the webbing used to form the straps may be flat, for added strength, the webbing may partially encircle a core material, or be folded lengthwise around the core material. To seal the core material within the webbing, the edges of the webbing may be stitched, fused, or otherwise sealed along portions of the length of the strap portion or portions having a core, thereby preventing the core material from becoming disassociated with the webbing. The core material may be, for example, rope, hollow tube, cabling, etc. To the extent electronics are incorporated into the evaluation sled, wires, fiber optics, or other conductors may be embedded within the core (e.g., within a tube or conduit) to communicate signals from end to end.

The sled 100 preferably comprises a semi flexible base structure 102, preferably made of a sheet of high density polyethylene ("HDPE"), although any suitable material may be used, such as Kevlar, composites, resins, other high density plastics, etc. The base structure 102 is sufficiently flexible such that it can be rolled into a cylinder for storage and transportation, but sufficiently rigid so that, when curled into a half cylindrical shape (as shown in FIG. 1), it assumes sufficient rigidity to support an adult (e.g., up to 250 lbs.) lying therein. The base structure 102 may be formed from a single sheet of material wherein the various slits 106, 110, 115, 122*a*, 122*b* for the straps and handholds are cut out using, for example, a punch or die. Using a single sheet to form the base structure 102 eliminates the cost of fusing multiple sheets together and ensures a substantially uniform material strength (e.g., it eliminates the potential weakness at the joints).

Figure 2:
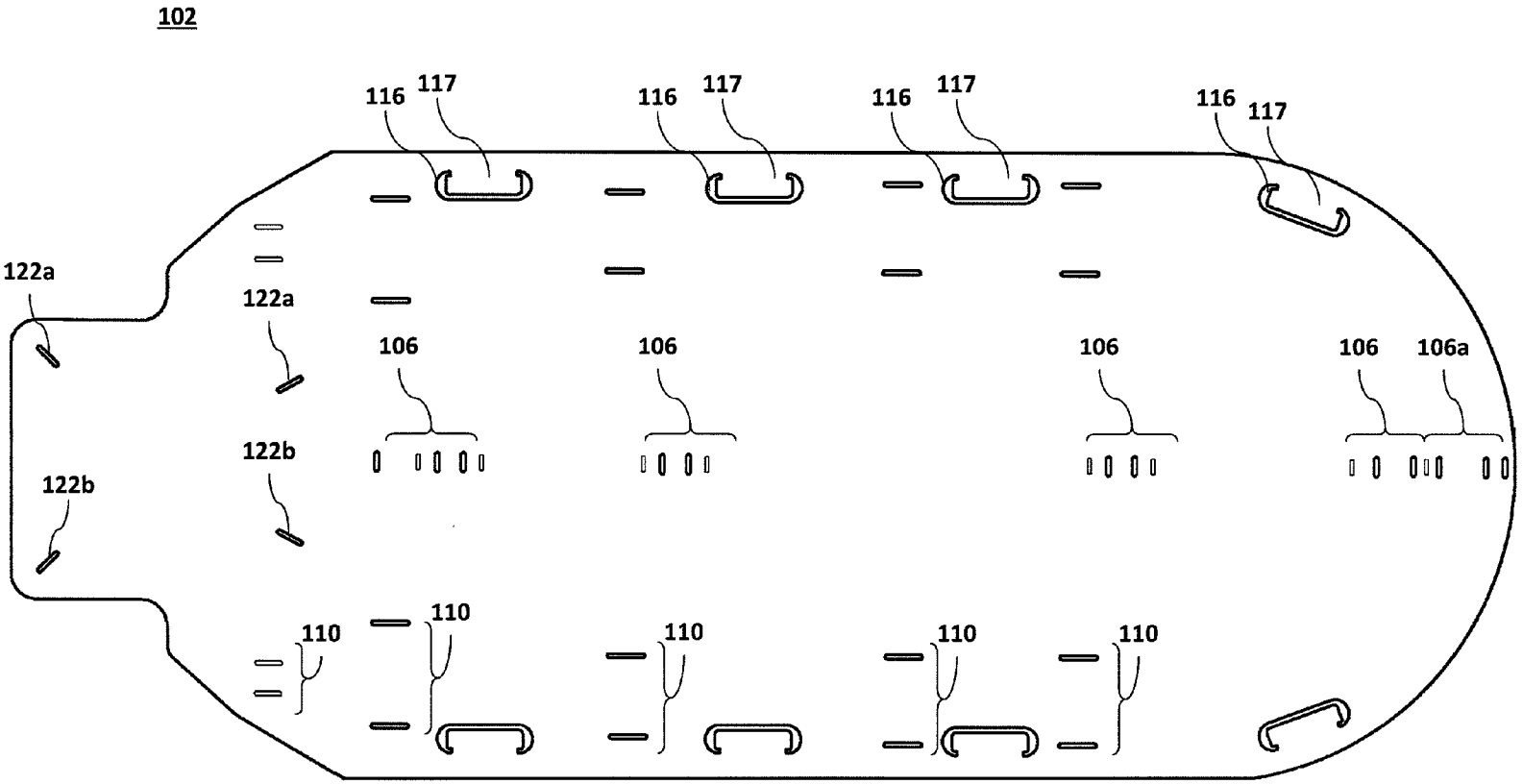
FIG. 2 is a top plan view of a base structure that may be used to form the evacuation sled of FIG. 1.

FIG. 2 provides a detailed view of the base structure 102. The base structure 102 is preferably about 75 inches to about 100 inches in length, more preferably about 80 inches to about 95 inches, and most preferably about 85 inches to about 90 inches long, with a width of about 25 inches to about 55 inches, more preferably about 30 inches to about 40 inches, and most preferably about 34 inches to about 38 inches. However, the base structure 102 could be any suitable size to support a person lying down. As shown in FIG. 2, the head of the base structure 102 may be rounded or hemispherical in shape, which may protect the head of a patient lying therein and provide a skid ramp when the sled and patient are being dragged. However, other shapes may also be employed for the head of the base structure 102, such as, triangular, rectangular, etc. The foot end of the sled 100 may have a portion projecting from the base structure 102, which may be rectangular in shape (e.g., 12 to 18 inches wide) and configured to lie over and protect the patient's feet when the base structure 102 is rolled upward and the foot portion is drawn up toward the patient's ankles. Weight is often important for such sleds, and rescue sleds should preferably weigh less than about 10 pounds. The preferred sled, including the straps, weighs only about 6 pounds. Such a sled also can be rolled into cylindrical form, preferably with a diameter less than about 10 inches. The preferred sled can be rolled into a cylinder less than 6 inches in diameter. The preferred thickness of the base structure 102, which may comprise HDPE, is 0.05 to 0.5 inch thick, more preferably 0.1-0.25 inch thick.

Figure 3:
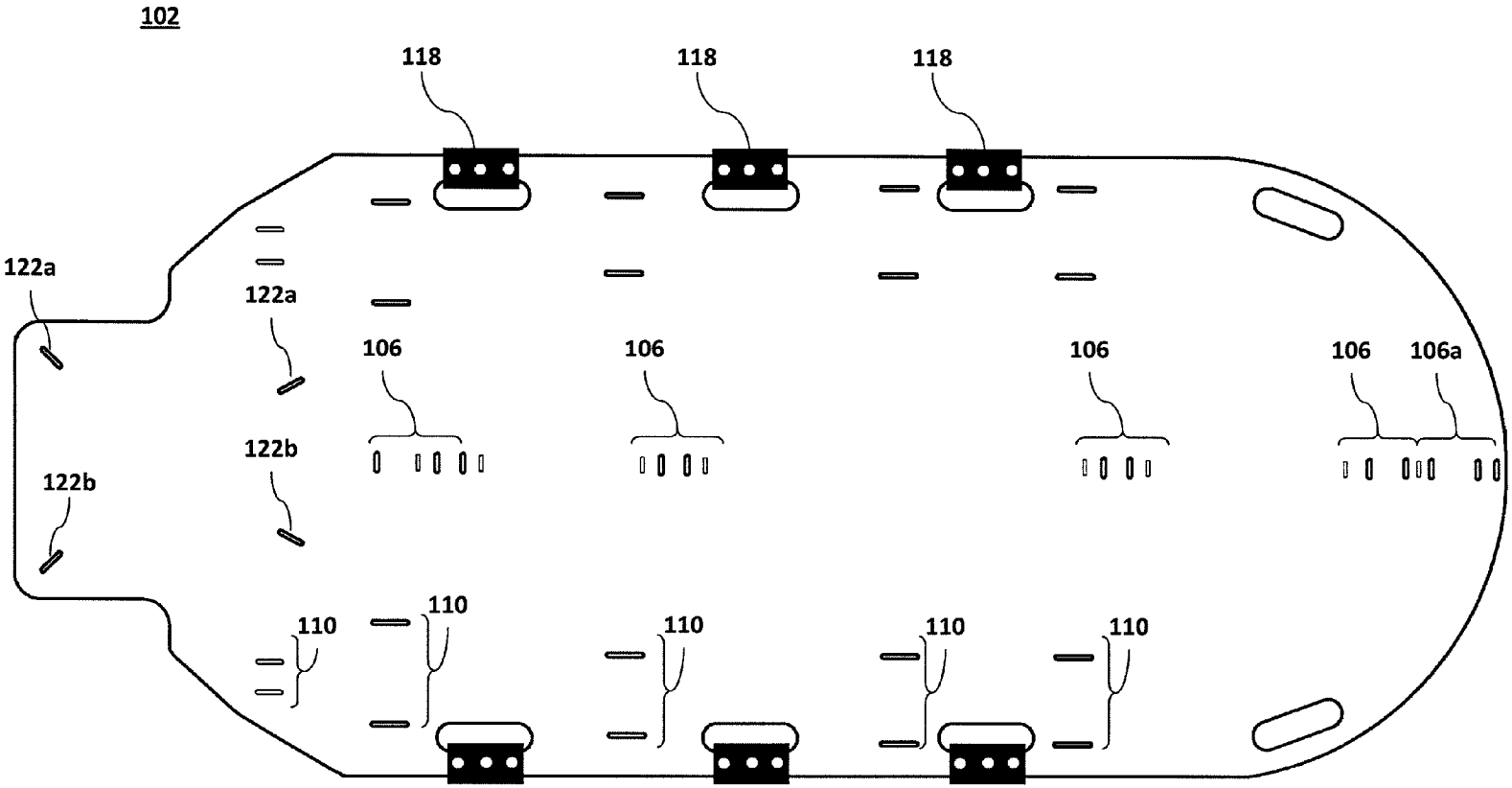
FIG. 3 is a top plan view of the base structure of FIG. 2 wherein the handholds have been wrapped in a padded material.

Around the periphery of the base structure 102 are a plurality of handholds 116, which may be used to grip and lift the sled 100 when a patient is lying therein. Each handhold 116 may be a corner-rounded slot approximately 3-6 inches long and 1-3 inches wide. The handholds 116 may be positioned depending on the desired application, such as approximately 14-18 inches apart. In order to reinforce the handhold 116, a reinforcing member 117 (e.g., the portion of material punched out to create the handhold 116) may be adhered to the base structure 102 immediately above the handhold 116 hole. Therefore, the reinforcing member 117 may be formed by cutting out the bottom and sides of the handhold 116 and then folding the cut-out portion upward and adhering it to the base structure 102 by welding, gluing, etc. This provides additional strength to the handhold 116 and also provides a more comfortable, thicker (i.e., twice the thickness) grip for the nurse(s) transporting the patient. As illustrated in FIG. 3, the handholds 116 may be further padded 118 to provide additional comfort. For example, a high density foam may be removably coupled to the handle portion using, for instance, snaps or hook and loop fasteners. Alternatively, the handholds may be constructed from a length of material, such as a strap, rope, or webbing, wherein the distal ends of the length of material are attached to the base structure 102 to form a handle shape (e.g., a U-shape).

Figure 4A:
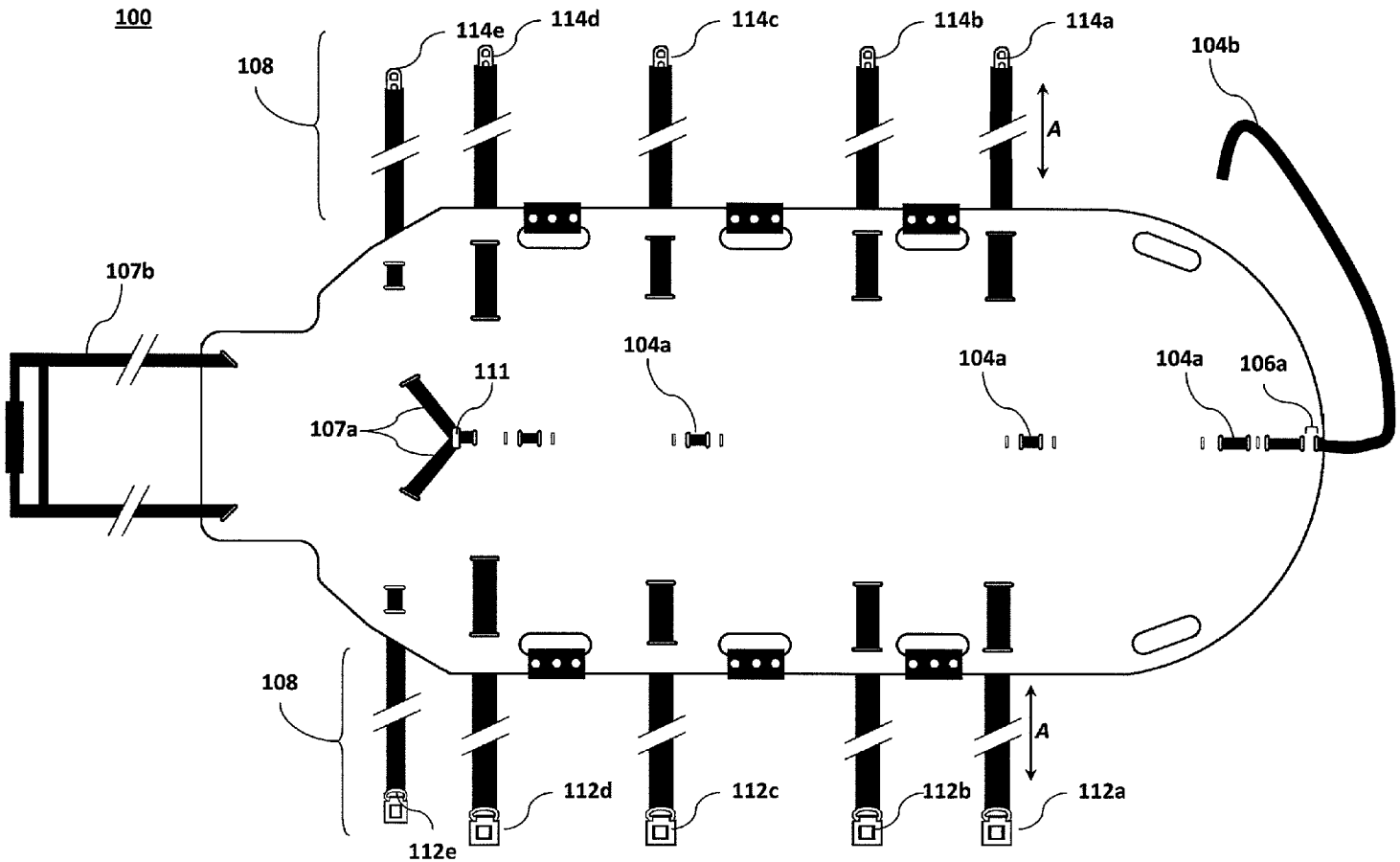
FIG. 4*a* is a top plan view of the underside of an evacuation sled in accordance with an embodiment of the present invention.
Figure 4B:
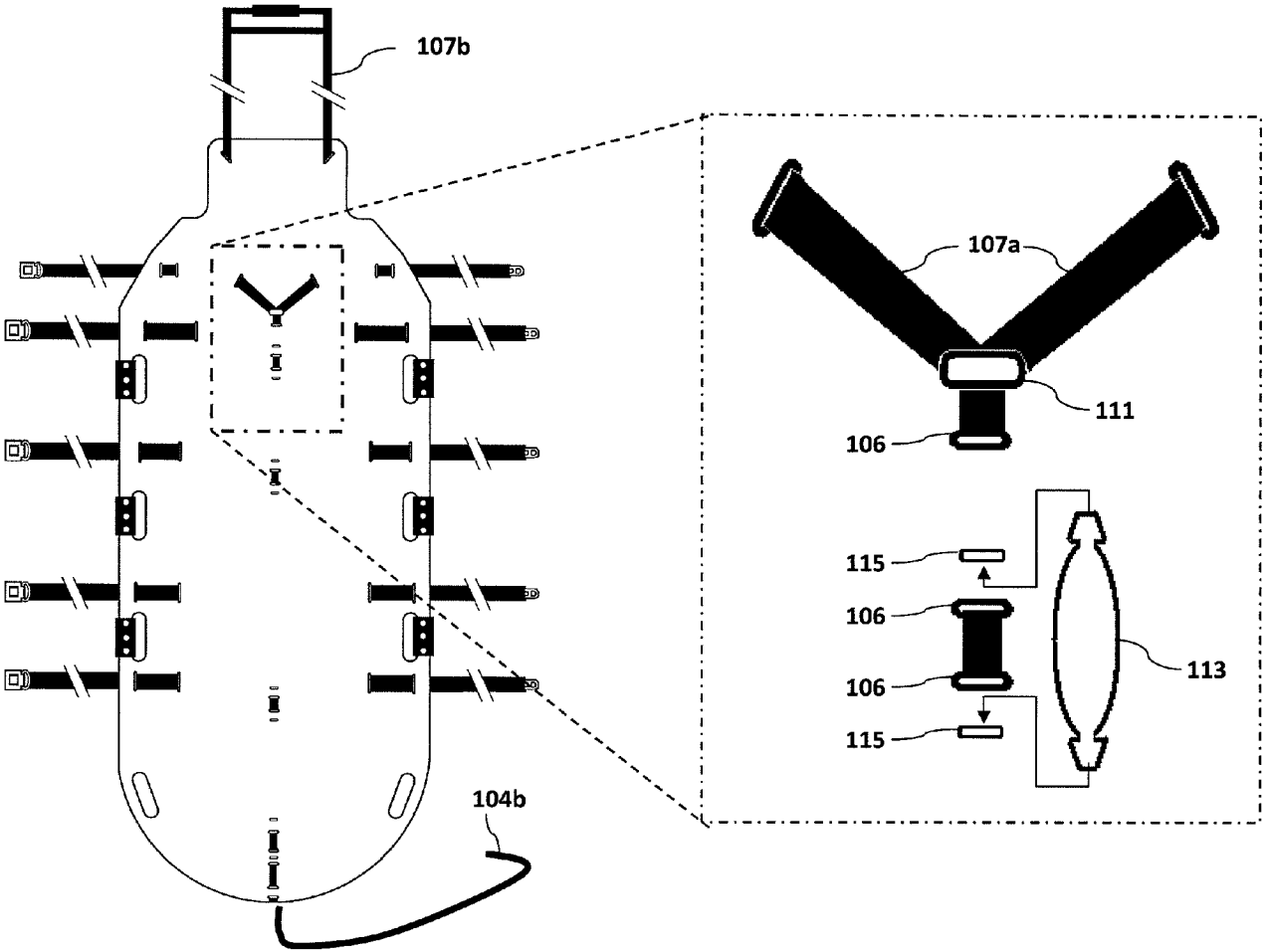
FIG. 4*b* is an exploded view of the underside of the evacuation sled of FIG. 4*a;*
Figure 5A:
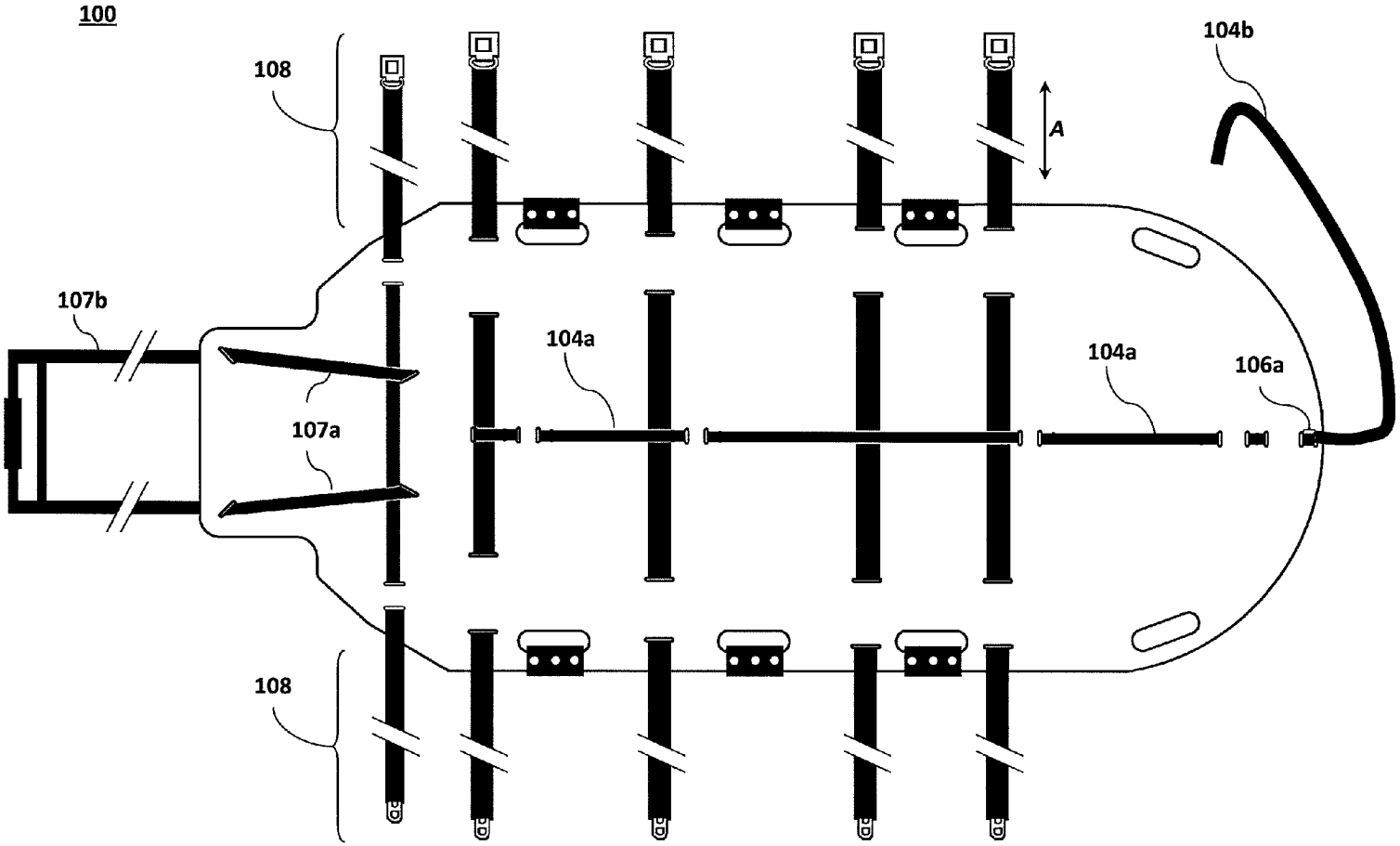
FIG. 5*a* is a top plan view of the topside of the evacuation sled of FIGS. 4*a* and 4*b;*

The underside of the sled 100 is shown in FIGS. 4*a* and 4*b* while the topside of the sled 100 is shown in FIG. 5. As illustrated, one or more longitudinal straps 104*a* may be disposed along the center line (e.g., longitudinal axis) of the base structure 102, passing through a number of corresponding slits 106. In particular, the longitudinal strap 104*a* is woven into the base structure 102, going from underneath to on top and back again, by passing through a plurality of slits 106, which are disposed in a spaced arrangement along the center line of the base structure 102. The slits 106 are sized to accept the longitudinal strap 104*a*. The distal end of the longitudinal strap 104*a* may also be used as a head pull strap 104*b*, which may be a handle or a tie structure to assist in transporting the patient. The head pull strap 104*b* may be disposed at the head of the base structure 102 such that one or more nurses may pull the sled during evacuation.

Figure 5B:
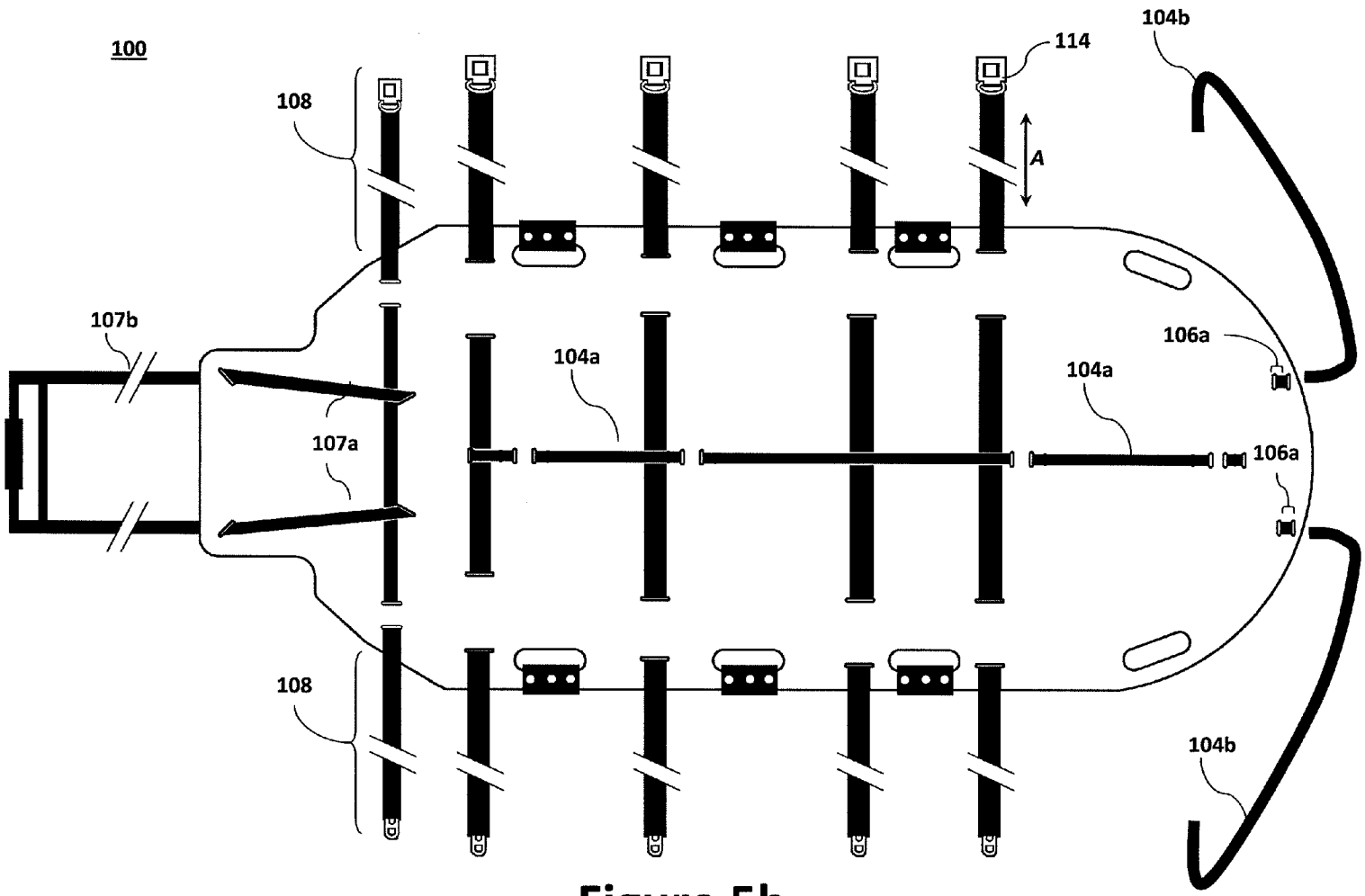
FIG. 5*b* is a top plan view of the topside of an evacuation sled having an option second head pull strap.

The head pull strap 104*b* may be an extension of the longitudinal strap 104*a* (e.g., a single length of material), or may be coupled thereto by stitching, tying, gluing, bolting, hook and loop-ing (e.g., Velcro®), welding, etc. The head pull strap 104*b* may also be separate from the longitudinal strap 104*a*. Whether a single length of material or multiple lengths of material, the head pull strap 104*b*, or a portion thereof, may be woven through a plurality of head pull strap slits 106*a* disposed at the head end of the base structure 102. The head pull strap slits 106*a* may be substantially the same as the slits 106 or, in the alternative, may be larger or smaller to accommodate the size of the head pull strap 104*b*. In certain aspects, additional head pull strap slits may be provided to facilitate additional head pull straps 104*b* or, as illustrated in FIG. 5*b*, to form a Y shape thereby splitting to provide two head pull strap 104*b* so that two people may pull the evacuation sled 100 (similar to the foot end configuration).

The longitudinal strap 104*a* extends substantially all the way to the foot end of the base structure 102. As illustrated in FIG. 4*b*, the end of the longitudinal strap 104*a* passes through slits 106, and is then turned back on itself and secured to a lower portion of the longitudinal strap 104*a* by the ring 111 using, for example, stitching, welding, gluing, or some other means of attachment. The ring 111 can be metal, plastic, cloth, or any other material to provide the proper strength to hold the longitudinal strap 104*a* together. Also attached to the ring 111 are ankle straps 107*a*, which may pass through a plurality of left side foot strap slits 122*b* disposed at substantially 30-60 degrees with respect to said longitudinal axis, and a plurality of right side foot strap slits 122*a* disposed at substantially 30-60 degrees with respect to said longitudinal axis. As illustrated, at least one right side foot strap slit 122*a* and at least one left side foot strap slit 122*b* may be positioned on the rectangular projecting portion. The end of the ankle straps 107*a* opposite the ring 111 end may be coupled with the foot end handle 107*b*. Alternatively, the ankle straps 107*a* and foot end handle 107*b* may be constructed from a single length of material. Accordingly, under either configuration, the foot end strap 107*b* may be further woven through said plurality of left side foot strap slits 122*b* and said plurality of right side foot strap slits and coupled to said head pull strap via ring 111, and configured such that, when tension is applied to said head pull strap, at least a portion of said foot end rectangular portion moves upward to at least partially enclose the feet of the patient.

Thus, as with the head end strap 104*b*, the ankle straps 107*a* and foot pull strap/handle 107*b* may be formed from a single length of material, or alternatively may be separate and joined using stitching, welding, gluing, or some other means of attachment. When the end of the head pull strap 104*b* is pulled, it pulls the ankle straps 107*a* via the longitudinal strap 104*a* and ring 111, which raises the rectangular projecting portion of the foot end of the base structure 102, thus enclosing the top and/or bottom and/or sides of the feet of the patient. Therefore, under this embodiment, the head end strap 104*b* and foot pull strap 107*b* are connected thereby increasing the structural integrity of the sled 100 by providing a continuous span of straps and connectors. While the illustrated continuous span of straps and connectors may be comprised of a number of strap sections connected end to end, it is entirely possible to form the entire strap structure from a single length of material. For example, in lieu of the ring 111, the strap may be spliced to facilitate the Y-shape configuration.

The head pull strap 104*b* and foot pull strap 107*b* may also pass through additional slits in the base structure 102 to provide added security. A foot pull strap 107*b* may also be provided at the foot of the base structure 102, and may be configured and/or arranged such that it is coupled with the longitudinal strap 104*a* as discussed above with respect to the head pull strap 104*b*. The foot pull strap 107*b* and head pull strap 107*b* may also include an H-shaped harness for added handles during evacuation. For example, FIG. 4*a* illustrates a foot pull strap 107*b* having an H-shaped harness.

A plurality of body retaining straps 108 (e.g., five) are located substantially transverse to the longitudinal axis of the base structure 102, and are preferably woven into the base structure 102 through slits 110 (in substantially the same way as longitudinal strap 104*a*), but with the ends of the body strap 108 (e.g., a patient retention strap) extending outwardly from either side of the base structure 102. Attached to either end of the body straps 108 is a fix-and-release structure, such as buckle and tang, clips, ties, hook and loop fasteners (e.g., Velcro®), etc. Preferably, the fix-and-release structure comprises a female buckle connector 112 and a male buckle tang 114, respectively. Buckle connectors 112 and 114 are configured to be length-adjustable and releasably attachable to each other, in a manner similar to a standard automobile seatbelt buckle or any other suitable device. Preferably, the buckle connectors 112 and 114 are corrosion resistant and unaffected by sea water or fresh water, and their physical properties will remain constant over a wide range of temperatures, relative humidities, and weather conditions. The body straps 108 are preferably adjustably attached to one or both of the buckle connectors 112 and 114 so that the length 'A' of the body strap 108 located between the buckle connectors 112 and 114 is adjustable. Of course, the body strap 108 can be fixedly attached to the buckle connectors 112 and 114 and have some other means of adjusting said length 'A' between said buckle connectors. The body straps 108 may be used to both secure the patient in place and to maintain the hemispherical shape during operation, as illustrated in FIG. 1.

To prevent abrasion to the longitudinal strap 104*a* portions that are exposed on the underside of the base structure 102, a shield 113 may be provided to couple with the base structure 102 and to cover the strap portions. The shield 113 may be configured to fit into slits 115 and may be constructed from the same material as the base structure 102. Alternatively, other material may be used to decrease friction. Thus, the shield 113 may also provide the added benefit of reducing friction while being pulled.

Figure 5C:
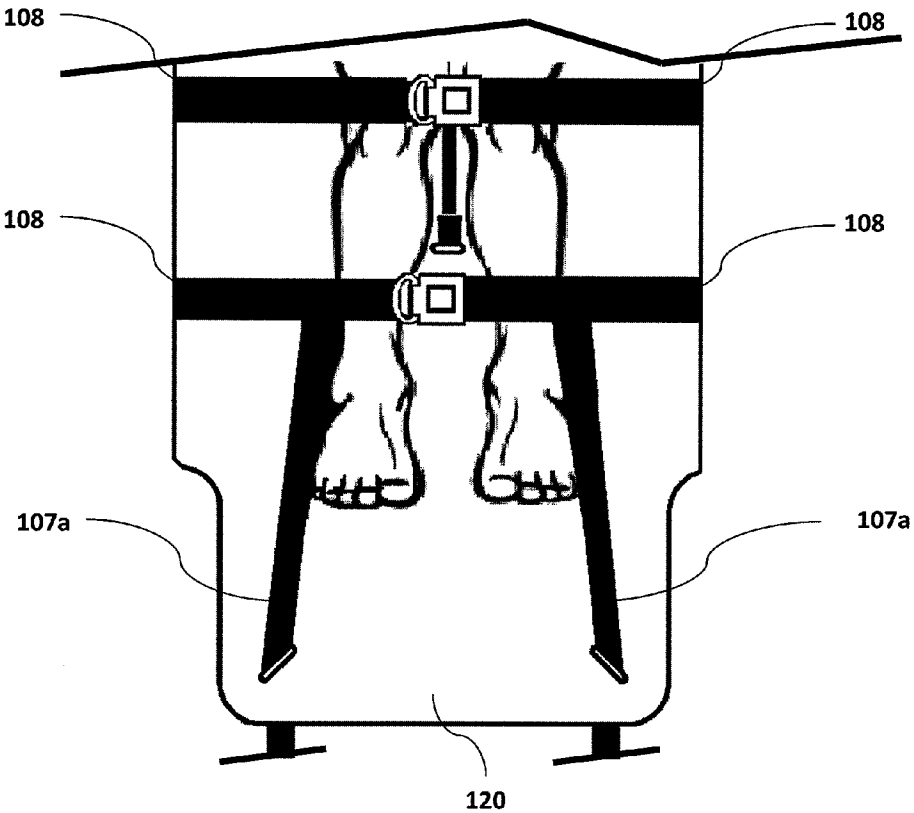
FIG. 5*c* is a top plan view of the foot end of the topside of the evacuation sled with an patient secured in place.

As illustrated in FIG. 5*c*, the ankle straps 107*a* are preferably configured such that one ankle strap 107*a* is positioned on each side of the patient's ankles. This configuration is advantageous because it will prevent lateral movement of the patient's legs during transport, while the body straps 108 prevent vertical movement. Each ankle strap 107*a* may be disposed at substantially 0-30 degrees, more preferably 5 to 15 degrees, with respect to the longitudinal axis of the base structure 102. Thus, once strapped in, the patient's legs are essentially locked in place and the rectangular projecting portion 120 may be folded over the patient's feet. While this configuration is preferred, other configurations are contemplated. For example, additional slits may be provided to further secure the evacuee's lower leg area. In certain aspects, a padded material may be wrapped around, or integrated with the ankle straps to increase the comfort to the patient. Accordingly, instead of resting against straps, the patient's legs will rest against cushioned material. Likewise, the body straps 108 and any other straps may be padded to increase the comfort to the patient and/or the caregiver.

In a certain aspect, the bottom side of the base structure 102 may further comprise wheel housings disposed in a spaced-apart relationship to allow the sled 100 to be rolled on the ground or other rough surfaces. The wheel housings preferably have a generally trapezoidal cross section to aid in sliding over obstacles as the sled 100 is pulled during use. The wheel housings preferably comprise a plurality of wheel structures. The wheel structures can be any structure known in the art for allowing an object to roll over a surface including but not limited to wheel and axle assemblies, ball bearings, cylindrical members, etc. It will be appreciated by one skilled in the art that the wheel housing and the wheel structure the sled 100 to be pulled with greater ease over a surface allowing a bedridden patient to be evacuated by a single person. Of course, the wheel housings and the wheel structures can be arranged in any configuration and in any number or they can be omitted from the sled 100 altogether. Alternatively, the wheel housings may be detachable from the bottom side of the base structure 102. In fact, the wheel housings may be integrated with the shields 113, thus serving the dual purpose of protecting the strap while providing a base to facilitate caster placement.

U.S. patent Ser. No. 12/968,840 entitled "Subway Evacuation Mattress and Method of Manufacture" to Kenalty et al., teaches a sled having a number of casters, or wheels, positioned on the underside of the mattress, or sled, to reduce the friction when being dragged. As taught by the specification, the casters are ideally a plastic material, and may be mounted on spinal plates embedded within the mattress.

In certain aspects, the sled 100 may be provided with a flotation device to facilitate transportation over water. Commonly owned U.S. Pub. No. US 20110185504, entitled "Evacuation Sled for Non-Ambulatory Patients" to Kenalty et al., teaches a sled having flotation structures disposed towards either side of the base and running substantially along the length of the base. The flotation structures are preferably detachably attached to the base by straps which pass through slits and around the flotation structures to effectively hold the flotation structures in place. Also disclosed are techniques for integrating wheels into the underside of the sled.

Thus, what has been described are a number of evacuation sled embodiments that are inexpensive to manufacture, efficient to store, and easy to use, yet which will protect the patient during transport.

While the present invention has been described with respect to what is presently considered to be the preferred embodiments, it is to be understood that the invention is not limited to the disclosed embodiments. To the contrary, the invention is intended to cover various modifications and equivalent arrangements included within the spirit and scope of the appended claims. The scope of the following claims is to be accorded the broadest interpretation so as to encompass all such modifications and equivalent structures and functions.

All U.S. and foreign patent documents, all articles, brochures, and all other published documents discussed above are hereby incorporated by reference into the Detailed Description of the Preferred Embodiment.

What is claimed is:

1. A patient evacuation sled apparatus, comprising:

a semi-rigid plastic sheet having (i) a head end and (ii) a foot end with a portion projecting therefrom;

a plurality of body strap slits disposed along each of left and right sides of said plastic sheet;

a plurality of body straps woven through respective ones of said plurality of body strap slits, each body strap comprising a fix and release structure configured to releasably couple to secure a patient on said plastic sheet, said plurality of body straps and said plurality of body strap slits being configured to cause said plastic sheet to curve upward into a semi-cylindrical shape when said body straps are tightened;

a plurality of head pull strap slits disposed substantially on a longitudinal axis of said plastic sheet;

a head pull strap woven through the plurality of said head pull strap slits and configured to permit a person to pull said plastic sheet from the head end of said plastic sheet;

a plurality of left side foot strap slits and a plurality of right side foot strap slits; and two ankle straps woven through said plurality of left side foot strap slits and said plurality of right side foot strap slits and coupled to a connection point.

2. The apparatus according to claim 1, wherein the ankle straps are configured such that, when tension is applied to said head pull strap, at least a portion of said foot end rectangular portion moves upward to at least partially enclose the feet of the patient, wherein the ankle straps are preferably configured such that each ankle strap is positioned on each side of the patient's ankles thereby reducing lateral movement of the patient's legs during transport.

3. The apparatus according to claim 1, further comprising a plurality of handholds disposed along each of the left and right sides of said plastic sheet, at least one of said handhold having a reinforcing plastic member disposed on an outer edge of said each handhold.

4. The apparatus according to claim 1, wherein said ankle straps, said plurality of left side foot strap slits, and said plurality of right side foot strap slits are configured such that, when tension is applied to said head pull strap, at least a portion of a lower left side portion of said plastic sheet and at least a portion of a lower right side portion of said plastic sheet move upward to at least partially enclose the feet of the patient.

5. The apparatus according to claim 1, further comprising a foot pull strap coupled to said ankle straps and configured to permit a person to pull said plastic sheet from the foot of said plastic sheet.

6. The apparatus according to claim 1, wherein at least two portions of said foot strap are disposed at substantially 5-15 degrees with respect to the longitudinal axis.

7. The apparatus according to claim 1, further comprising at least one wheel assembly disposed on a surface of said plastic sheet.

8. The apparatus according to claim 1, further comprising at least one flotation device disposed on a bottom surface of said plastic sheet.

9. The apparatus according to claim 1, wherein the semi-rigid plastic sheet comprises high density polyethylene.

10. The apparatus according to claim 1, wherein the ankle straps partially encircle a core material.

11. The apparatus according to claim 1, wherein the plurality of left side foot strap slits and the plurality of right side foot strap slits are disposed at substantially 30-60 degrees with respect to said longitudinal axis.

12. An evacuation sled, comprising:

a plastic sheet having a head end and a foot end;

a plurality of body straps coupled to said plastic sheet and configured to secure a patient in said plastic sheet when said plastic sheet is curved upward about the patient;

a head pull strap woven through a plurality of head pull strap slits and configured to permit a person to pull said plastic sheet from the head end of said plastic sheet;

two ankle straps affixed to the head pull strap and coupled at the foot end of said plastic sheet; and a pull strap coupled to at least one of the two ankle straps and configured to permit a person to drag the patient strapped to the plastic sheet.

13. The sled according to claim 12, wherein the plastic sheet includes a plurality of handholds disposed about left and right side edges of said sheet, at least one handhold comprising an opening with a plastic reinforcement above said opening.

14. The sled according to claim 12, wherein said head pull strap and said ankle straps are each coupled to said plastic sheet by being woven into said plastic sheet through a respective plurality of slits therein, and wherein, when said tension is applied to said head pull strap, said foot strap moves with respect to at least one respective slit in said plastic sheet.

15. The sled according to claim 12, wherein said ankle straps are woven to said plastic sheet with a plurality of foot strap slits which are disposed non-parallel and non-perpendicular to a longitudinal axis of said plastic sheet.

16. The sled according to claim 12, further comprising a ring that couples said ankle straps to said head pull strap.

17. The sled according to claim 12, further comprising at least one flotation device disposed on a surface of said plastic sheet.

18. The sled according to claim 12, wherein the semi-rigid plastic sheet comprises high density polyethylene.

19. The sled according to claim 12, wherein the ankle straps partially encircle a core material.

20. An evacuation sled, comprising:

a semi-rigid plastic sheet having (i) a head end and (ii) a foot end with a portion projecting therefrom;

a plurality of handholds disposed along each of left and right sides of said plastic sheet, each handhold having a reinforcing plastic member disposed on an outer edge of said each handhold a plurality of body straps coupled to said plastic sheet and configured to secure a patient in said plastic sheet when said plastic sheet is curved upward about the patient;

a head pull strap woven through a plurality of head pull strap slits and configured to permit a person to pull said plastic sheet and the patient from the head of said plastic sheet;

two ankle straps configured to cause, when tension is applied to said head pull strap, at least one portion of said plastic sheet foot to raise upward and at least partially enclose the feet of the patient, wherein the ankle straps are preferably configured such that one ankle strap is positioned on each side of the patient's ankles thereby preventing lateral movement of the patient's legs during transport;

a ring for coupling said ankle straps to said head pull strap; and a pull strap coupled to at least one of the two ankle straps and configured to permit a person to drag the patient strapped to the plastic sheet.

* * * * *